US010136708B2

(12) United States Patent
Villard et al.

(10) Patent No.: US 10,136,708 B2
(45) Date of Patent: Nov. 27, 2018

(54) LIGHT PRECIOUS ALLOY OF GOLD AND TITANIUM AND COMPONENTS FOR TIMEPIECES OR JEWELLERY MADE FROM SUCH A LIGHT PRECIOUS ALLOY OF GOLD AND TITANIUM

(71) Applicant: Montres Breguet S.A., L'Abbaye (CH)

(72) Inventors: Gaetan Villard, L'Abbaye (CH); Denis Vincent, Neuchatel (CH); Stephane Lauper, Cortaillod (CH)

(73) Assignee: Montres Breguet S.A., L'Abbaye (CH)

( * ) Notice: Subject to any disclaimer, the term of this patent is extended or adjusted under 35 U.S.C. 154(b) by 144 days.

(21) Appl. No.: 15/308,185

(22) PCT Filed: Dec. 17, 2015

(86) PCT No.: PCT/EP2015/080270
§ 371 (c)(1),
(2) Date: Nov. 1, 2016

(87) PCT Pub. No.: WO2016/107755
PCT Pub. Date: Jul. 7, 2016

(65) Prior Publication Data

US 2017/0226613 A1 Aug. 10, 2017

(30) Foreign Application Priority Data

Dec. 29, 2014 (EP) ..... 14200381

(51) Int. Cl.

| | |
|---|---|
| ***C22C 5/02*** | (2006.01) |
| ***A44C 5/00*** | (2006.01) |
| ***A44C 27/00*** | (2006.01) |
| ***G04B 45/00*** | (2006.01) |
| ***G04B 37/22*** | (2006.01) |
| ***C22C 5/04*** | (2006.01) |
| ***C22C 30/00*** | (2006.01) |
| ***C22C 30/02*** | (2006.01) |
| ***C22C 14/00*** | (2006.01) |

(52) U.S. Cl.
CPC ..... *A44C 27/003* (2013.01); *A44C 5/00* (2013.01); *C22C 5/02* (2013.01); *C22C 5/04* (2013.01); *C22C 14/00* (2013.01); *C22C 30/00* (2013.01); *C22C 30/02* (2013.01); *G04B 37/22* (2013.01); *G04B 45/0076* (2013.01)

(58) Field of Classification Search
CPC ... A44C 5/0061; A44C 5/0076; A44C 5/0092; A44C 27/003; C22C 5/02; G04B 37/22
See application file for complete search history.

(56) References Cited

U.S. PATENT DOCUMENTS

| | | | |
|---|---|---|---|
| 2015/0368756 | A1 | 12/2015 | Dubos et al. |
| 2015/0368757 | A1 | 12/2015 | Dubos et al. |
| 2015/0378311 | A1 | 12/2015 | Dubos et al. |

FOREIGN PATENT DOCUMENTS

| | | | |
|---|---|---|---|
| DE | 43 06 542 | A1 | 7/1994 |
| EP | 2 546 371 | A1 | 1/2013 |
| GB | 876887 | A | 9/1961 |
| WO | WO 2007/009472 | A1 | 1/2007 |
| WO | WO 2010/027329 | A1 | 3/2010 |
| WO | WO 2014/122233 | A1 | 8/2014 |

OTHER PUBLICATIONS

John Daintith, ed., A Dictionary of Chemistry, Sixth Ed., Oxford Univ. Press, 2008, p. 225. (Year: 2008).*
International Search Report dated May 2, 2016, in PCT/EP2015/080270 filed Dec. 17, 2015.

* cited by examiner

*Primary Examiner* — Scott R Kastler
*Assistant Examiner* — Vanessa T. Luk
(74) *Attorney, Agent, or Firm* — Oblon, McClelland, Maier & Neustadt, L.L.P.

(57) ABSTRACT

Light, precious gold-titanium based alloy containing, by mass, at least 750‰ of gold, characterized in that said alloy has the following composition formula:

$Ti_aAu_bM_cT_d$ where a, b, c, d are atomic proportions such that:

$a+b+c+d=1$, $0.45 \leq a \leq 0.55$; $0.41 \leq b \leq 0.495$; $0.025 \leq c \leq 0.13$; $0.001 \leq d \leq 0.025$,
where M represents one or more elements taken from among a first group including Nb, V, Pd, Pt, Fe,
and where T represents a maximum of two elements taken from among a second group including Nb, V, Pd, Pt, Fe, Mo, Ta, W, Co, Ni, Ru, Rh, Ir, Cr, Mn, Cu, Zn, Ag, Al, B, Si, Ge, Sn, Sb, In, with the exception of said metals M comprised in said alloy.
Component for timepiece or for jewellery made from such a light, precious gold-titanium based alloy.

14 Claims, No Drawings

LIGHT PRECIOUS ALLOY OF GOLD AND TITANIUM AND COMPONENTS FOR TIMEPIECES OR JEWELLERY MADE FROM SUCH A LIGHT PRECIOUS ALLOY OF GOLD AND TITANIUM

FIELD OF THE INVENTION

The invention concerns a light, precious, gold-titanium based alloy, containing, by mass, at least 750‰ of gold.

The invention further concerns components for timepieces or jewellery made of such a light, precious, gold-titanium based alloy.

The invention concerns the field of structural or external components for timepieces or jewellery made of an 18-carat gold alloy.

BACKGROUND OF THE INVENTION

A common feature of most precious metal alloys used in watchmaking is their high density—higher than 10 g/cm$^3$. In fact, the two main precious metals used in watchmaking, gold and platinum, have respective densities of around 19.3 and 21.5 g/cm$^3$. Consequently, this makes their alloys relatively heavy.

Gradable gold alloys are usually very dense because of their high gold content, and due to the fact that they only rarely incorporate a large quantity of light elements. Moreover, if gold is alloyed with a large quantity of light elements, this usually results in fragile components.

The Ti—Au system has, however, been studied, in the equiatomic intermetallic compound TiAu zone.

In their binary or tertiary form, these alloys are known to have a shape memory effect, particularly alloys with the atomic compositions $Ti_{50}Au_{50}$ et $Ti_{50}Ni_{10}Au_{40}$.

As regards the shape memory effect, a drop in temperature Ms has also been observed following the addition of ternary elements to $Ti_{50}Au_5$ alloys.

TiAuFe alloys with 5, 10, 14, 15 and 20 atomic percent of iron, and TiAuCo and TiAuCoNb alloys, have been the subject of particular studies, with no usable results for the problem.

Although the biocompatibility of these alloys is often put forward for medical applications, no composition has been proposed that is intended both to achieve 18K carat gold fineness without any surplus and acceptable mechanical properties for making external timepiece components.

EP Patent Application 2548982A1 discloses alloys containing from 50% to 99% of titanium and, more precisely, alloys containing one precious element in addition to titanium, ideally between 5 and 15% of precious metal. It is noted that a gold-titanium alloy containing 5 to 15% of gold cannot achieve 18-carat gold fineness, since the required proportion by mass of 75% of gold is not attained.

U.S. Pat. No. 4,568,398 describes Ti—Au alloys containing between 95% and 40% by mass of titanium, but wherein the rest of the composition, and particularly the low proportion of gold, precludes the alloys from achieving 18 carat gold fineness.

WO Patent Application 2008/018109A1 describes gold and titanium alloys with a fineness of between 6K and 18K, with shape memory properties, which is not desired, or superelasticity, and having elongation at break. Most of these alloys are compositions containing nickel, which is not desirable for the manufacture of external timepiece or jewellery components, which likely to come into contact with human skin. This document discloses only two 18K compositions: $Ti_{11.23}Ni_{13.77}Au_{75}$ et $Ti_{12.5}Ni_{12.5}Au_{75}$ by mass. These two compositions are very far from a content of 50 atomic percent of titanium, and contain nickel, making them unsuitable for use in external timepiece components.

SUMMARY OF THE INVENTION

The invention proposes to develop an alloy that can be classified as 18 carat gold, which is easy to shape to produce external timepiece or jewellery components, such as watch cases, bracelets, pieces of jewellery or suchlike, and which is also lighter than a conventional gold alloy while having excellent mechanical properties, like those that titanium alloys may enjoy.

To this end, the invention concerns a light, precious gold-titanium based alloy, containing, by mass, at least 750‰ of gold, according to claim 1.

The invention also concerns timepiece or jewellery components made of such a light, precious gold-titanium based alloy.

In short, the present invention consists of a ductile alloy based on the equiatomic intermetallic compound TiAu in which any gold surplus with respect to the mass content required for 18 carat fineness is replaced by another non-precious element, such that titanium still represents 50 to 51 atomic percent of the final alloy and gold 750‰ by mass (i.e. 18 carats). Such an alloy has sufficient ductility to provide similar shapeability to that of conventional titanium alloys.

DETAILED DESCRIPTION OF PREFERRED EMBODIMENTS

All of the concentrations expressed in the present description are atomic proportions, unless otherwise specified, in particular as regards gold.

The invention concerns a gold-titanium dominant alloy in the following formulation:

$$Ti_aAu_bM_cT_d$$

where a, b, c, d are atomic proportions such that:

$$a+b+c+d=1,$$

$0.45 \leq a \leq 0.55$;
$0.41 \leq b \leq 0.495$;
$0.025 \leq c \leq 0.13$;
$0.001 \leq d \leq 0.025$,
where M represents one or more elements taken from among a first group including Nb, V, Pd, Pt, Fe,
where the gold mass content is greater than or equal to 750‰,
and where T represents a maximum of two elements taken from among a second group including Nb, V, Pd, Pt, Fe, Mo, Ta, W, Co, Ni, Ru, Rh, Ir, Cr, Mn, Cu, Zn, Ag, Al, B, Si, Ge, Sn, Sb, In, with the exception of the metals M comprised in this alloy.

Parameter "a" defines the fraction of titanium.

Parameter "b" defines the fraction of gold.

Parameter "c" defines the total fraction of elements M.

Parameter "d" defines the total fraction of elements T.

The alloy includes 750‰ by mass of gold. This mass percentage of the alloy is naturally not inconsistent with the atomic proportions of the alloying elements, it is an additional condition related to fineness grading, and which is not at all incompatible with the alloy compositions described in the present invention.

More particularly, for applications relating to components that might come into contact with a user's skin, nickel is excluded from the alloy, and the formulation is restricted as regards T, which represents a maximum of two elements taken from among a third group corresponding to second group from which nickel is removed, and including: Nb, V, Mo, Ta, W, Fe, Co, Ru, Rh, Ir, Pd, Pt, Cr, Mn, Cu, Zn, Ag, Al, B, Si, Ge, Sn, Sb, In, with the exception of the metals M comprised in this alloy.

The same alternative concerns the whole of the present description for any alloy likely to be used in a similar application.

More particularly, the fraction of titanium "a". of gold "b" and of element M "c" of the formulation is restricted in the form:

$$Ti_aAu_bM_cT_d$$

with $0.48 \le a \le 0.52$; $0.42 \le b \le 0.48$; $0.025 \le c \le 0.10$; $0.001 \le d \le 0.025$.

More particularly, the fraction of titanium "a" and of element M "c" of the formulation is restricted in the form:

$$Ti_aAu_bM_cT_d$$

with $0.49 \le a \le 0.51$; $0.42 \le b \le 0.48$; $0.025 \le c \le 0.09$; $0.001 \le d \le 0.025$.

More particularly, the fraction of titanium "a". of gold "b" and of element M "c" of the formulation is restricted in the form:

$$Ti_aAu_bM_cT_d$$

with $0.50 \le a \le 0.51$; $0.42 \le b \le 0.47$; $0.025 \le c \le 0.08$; $0.001 \le d \le 0.025$.

The range of 0.50-0.51 for the atomic fraction of titanium corresponds to the range of stability of the equiatomic intermetallic phase TiAu at ambient temperature in the binary Ti—Au system.

More particularly still, T represents a maximum of two elements taken from among a fourth group that is more restricted than the third group and includes: Nb, V, Fe, Ru, Rh, Ir, Pd, Pt, Cr, Cu, Ag, B, with the exception of the metals M comprised in the alloy.

More particularly still, M represents one or more elements belonging to a fifth group corresponding to the first group from which vanadium has been removed and including: Nb, Pd, Pt, Fe.

More particularly still, in order to use boron as grain refiner, T represents, on the one hand, boron in a content comprised between 0.03% and 0.3%, and, on the other hand, at least in the case where the minimum value "d" of 0.1% is not attained, only one element from a sixth group including: Nb, V, Fe, Ru, Rh, Ir, Pd, Pt, Cr, Cu, Ag, in sufficient quantity such that value "d", which is the sum of the atomic fraction of boron and that of said element from said sixth group, is between 0.001 and 0.025.

The following compositions provide the formula for particularly promising alloys, combining ease of implementation, reduced density, attractive appearance and reduced surplus gold content, which is essential for watchmaking and jewellery applications.

The formulation is of the type:

$$Ti_aAu_bM_bT_d$$

with $0.50 \le a \le 0.51$; $0.42 \le b \le 0.47$; $0.025 \le c \le 0.08$; $0.001 \le d \le 0.025$, where M represents only one element from the fifth group including Nb, Pd, Pt, Fe, and where T represents boron in a content comprised between 0.03% and 0.3% and, at least in the case where the minimum atomic value "d" of 0.1% is not attained, only one element from the sixth group including: Nb, V, Fe, Ru, Rh, Ir, Pd, Pt, Cr, Cu, Ag, in sufficient quantity such that value "d", which is the sum of the atomic fraction of boron and that of said element from the sixth group, is between 0.001 and 0.025.

More particularly, M is iron.

More particularly, M is niobium.

More particularly, M is platinum.

More particularly, M is palladium.

More particularly, the mass content of gold in the alloy is less than 780‰.

More particularly still, the mass content of gold in the alloy is less than 760‰.

Examples of atomic compositions wherein a=0.50 and d=0.001 are given below:

| | |
|---|---|
| $Ti_{0.50}Au_{0.427}Fe_{0.072}B_{0.001}$<br>a = 0.50; b = 0.427; c = 0.072; d = 0.001 | Fineness of Au: 750.5‰ |
| $Ti_{0.50}Au_{0.444}Nb_{0.055}B_{0.001}$<br>a = 0.50; b = 0.444; c = 0.055; d = 0.001 | Fineness of Au: 750.6‰ |
| $Ti_{0.50}Au_{0.466}Pt_{0.033}B_{0.001}$<br>a = 0.50; b = 0.466; c = 0.033; d = 0.001 | Fineness of Au: 751.3‰ |
| $Ti_{0.50}Au_{0.448}Pd_{0.051}B_{0.001}$<br>a = 0.50; b = 0.448; c = 0.051; d = 0.001 | Fineness of Au: 750.3‰ |

Other examples of atomic compositions wherein a=0.505, and d represents two elements are set out below:

| | |
|---|---|
| $Ti_{0.505}Au_{0.4295}Fe_{0.050}Cr_{0.015}B_{0.0005}$<br>a = 0.505; b = 0.4295; c = 0.05; d = 0.0155 | Fineness of Au: 753‰ |
| $Ti_{0.505}Au_{0.4385}Nb_{0.041}Cr_{0.015}B_{0.0005}$<br>a = 0.505; b = 0.4385; c = 0.041; d = 0.0155 | Fineness of Au: 750.2‰ |
| $Ti_{0.505}Au_{0.448}Pd_{0.0365}Rh_{0.01}B_{0.0005}$<br>a = 0.505; b = 0.448; c = 0.0365; d = 0.0105 | Fineness of Au: 752.1‰ |
| $Ti_{0.505}Au_{0.463}Pt_{0.031}Ir_{0.0005}B_{0.0005}$<br>a = 0.505; b = 0.463; c = 0.031; d = 0.001. | Fineness of Au: 750.5‰ |

In a variant of the invention, several % of Zr or Hf, particularly between 0 and 3%, could replace part of the titanium. The formula of the alloy is then:

$$N_aAu_bM_cT_d$$

where a, b, c, d are atomic proportions such that:

$$a+b+c+d=1,$$

$0.45 \le a \le 0.55$;
$0.41 \le b \le 0.495$;
$0.025 \le c \le 0.13$;
$0.001 \le d \le 0.025$, where N is a composition of titanium, zirconium, hafnium, the atomic percent of zirconium being comprised between 0% and 3% of the alloy, the atomic percent of hafnium being comprised between 0% and 3% of the alloy.

where M represents one or more elements taken from among a first group including Nb, V, Pd, Pt, Fe, where the gold content is greater than or equal to 750‰, and where T represents a maximum of two elements taken from among a second group including Nb, V, Pd, Pt, Fe, Mo, Ta, W, Co, Ni, Ru, Rh, Ir, Cr, Mn, Cu, Zn, Ag, Al, B, Si, Ge, Sn, Sb, In, with the exception of the metals M comprised in this alloy.

The invention further concerns a timepiece or components for timepieces or for jewellery made from such a light, precious gold-titanium based alloy.

The invention has many advantages resulting from the aforementioned features:

- these alloys have moderate hardnesses less than or equal to 300 HV, and can therefore be shaped using ordinary deformation methods;

they can be classified with a fineness of 18 carats;

they are especially light in comparison to most alloys classified as 18 carat gold;

the nickel-free variant alloys are not dangerous for the human body.

The manufacture of external timepiece components from one of the aforecited alloys can advantageously optimise the alloy composition in different respects:

by adding elements that lower the melting point to facilitate implementation;

by changing the amount of the element that replaces the precious metal to change the mechanical properties of the alloy;

by making various slight modifications to obtain alloys with structural hardening.

The invention claimed is:

1. A light, precious gold-titanium based alloy comprising, by mass, from 750‰ to 780‰ of gold, wherein said alloy has the following composition formula:

$$Ti_aAu_bM_cT_d$$

where a b, c, d are atomic proportions such that:

$$a+b+c+d=1,$$

$0.45 \leq a \leq 0.55$; $0.41 \leq b \leq 0.495$; $0.025 \leq c \leq 0.13$; $0.001 \leq d \leq 0.025$, wherein M represents at least one element selected from the group consisting of Nb, V, Pd, Pt, and Fe, and T represents boron and optionally an additional element, and wherein the additional element is selected from the group consisting of Nb, V, Pd, Pt, Fe, Mo, Ta, W, Co, Ni, Ru, Rh, Ir, Cr, Mn, Cu, Zn, Ag, Al, Si, Ge, Sn, Sb, and In, M and T are different elements, and the alloy comprises the boron as T or as a part of T in an atomic content of from 0.03% to 0.3%.

2. The alloy according to claim 1, wherein the additional element is selected from the group consisting of Nb, V, Pd, Pt, Fe, Mo, Ta, W, Ru, Rh, Ir, Cr, Mn, Cu, Zn, Ag, Al, Si, Ge, Sn, and In.

3. The alloy according to claim 1, wherein $0.48 \leq a \leq 0.52$; $0.42 \leq b \leq 0.48$; $0.025 \leq c \leq 0.10$; $0.001 \leq d \leq 0.025$.

4. The alloy according to claim 3, wherein $0.49 \leq a \leq 0.51$; $0.42 \leq b \leq 0.48$; $0.025 \leq c \leq 0.09$; $0.001 \leq d \leq 0.025$.

5. The alloy according to claim 4, wherein $0.50 \leq a \leq 0.51$; $0.42 \leq b \leq 0.47$; $0.025 \leq c \leq 0.08$; $0.001 \leq d \leq 0.025$.

6. The alloy according to claim 5, wherein the additional element is selected from the group consisting of Nb, V, Pd, Pt, Fe, Ru, Rh, Ir, and Cr.

7. The alloy according to claim 6, wherein M represents at least one element selected from the group consisting of Nb, Pd, Pt, and Fe.

8. The alloy according to claim 1, wherein, when the atomic proportion of the boron is from 0.03% to 0.10%, the additional element is selected from the group consisting of Nb, V, Pd, Pt, Fe, Ru, Rh, Ir, and Cr.

9. The alloy according to claim 1, wherein M is iron.

10. The alloy according to claim 1, wherein M is niobium.

11. The alloy according to claim 1, wherein M is platinum.

12. The alloy according to claim 1, wherein M is palladium.

13. The alloy according to claim 1, wherein the mass content of the gold in said alloy is from 750‰ to 760‰.

14. A timepiece or jewelry component, comprising:

the light precious gold-titanium based alloy according to claim 1.

* * * * *